United States Patent [19]

Hill

[11] 4,004,862

[45] Jan. 25, 1977

[54] BATTERY POWERED FLUID TRANSFER APPARATUS

[75] Inventor: Billy R. Hill, Canyon; David L. Whatley, Amarillo, both of Texas

[73] Assignee: Cerco Tires Inc., Amarillo, Tex.

[22] Filed: Aug. 18, 1975

[21] Appl. No.: 605,591

[52] U.S. Cl. ..... 417/234; 152/427; 417/410; 417/411

[51] Int. Cl.[2] ..... F04B 21/00

[58] Field of Search ..... 417/326, 411, 362, 234, 417/410, 315; 152/415, 427, 429

[56] References Cited

UNITED STATES PATENTS

| | | | |
|---|---|---|---|
| 1,186,157 | 6/1916 | Abell | 417/234 |
| 1,438,225 | 12/1922 | De Ville | 417/362 |
| 1,497,575 | 6/1924 | Menge | 417/326 X |
| 2,415,019 | 1/1947 | McMahan | 152/415 X |
| 2,891,481 | 6/1959 | Franklin et al | 417/411 X |
| 3,015,281 | 1/1962 | Umholtz | 417/411 X |
| 3,495,767 | 2/1970 | Zrostlik | 417/362 X |
| 3,558,243 | 1/1971 | Trapp | 417/411 |

FOREIGN PATENTS OR APPLICATIONS

| | | | |
|---|---|---|---|
| 1,081,478 | 12/1954 | France | 417/362 |

*Primary Examiner*—William L. Freeh
*Assistant Examiner*—Edward Look
*Attorney, Agent, or Firm*—Wilkinson, Mawhinney & Theibault

[57] ABSTRACT

The present disclosure is directed to a fluid transfer apparatus of the battery powered type for use in remote locations where conventional power sources such as 110V ac is not available. The apparatus employs a motor driven positive displacement gear pump having supply and discharge lines. The motor is equipped with a reversing switch and battery connection cables.

1 Claim, 3 Drawing Figures

BATTERY POWERED FLUID TRANSFER APPARATUS

An object of the present invention is to provide a positive displacement gear pump with a motor drive not to exceed one-third hp drawing 28 amp at 1,750 rpm so that battery power from a conventional automobile or pick up truck battery can be employed for pumping fluids one place to another.

A further object of the present invention is to provide a battery powered pump apparatus which may be taken into the field to service tractors having 6 to 8 ft. diameter tires which have been filled with 80 to 100 gallons of calcium water which must be removed from the tire, placed in a holding drum, the tire replaced or serviced and the calcium water pumped from the holding drum back into the tire on a tractor or similar vehicle.

A still further object of the present invention is the provision of a light weight portable apparatus which can be carried by one man and which may be used in the field or in a plant wherever fluid transfer from one point to another and reverse is necessary and conventional power sources are not available but vehicle batteries are available.

With the foregoing and other objects in view the invention will be more fully described hereinafter and more particularly pointed out in the appended claims.

In the drawings in which like parts are denoted by reference characters throughout the several views.

Figure 1:
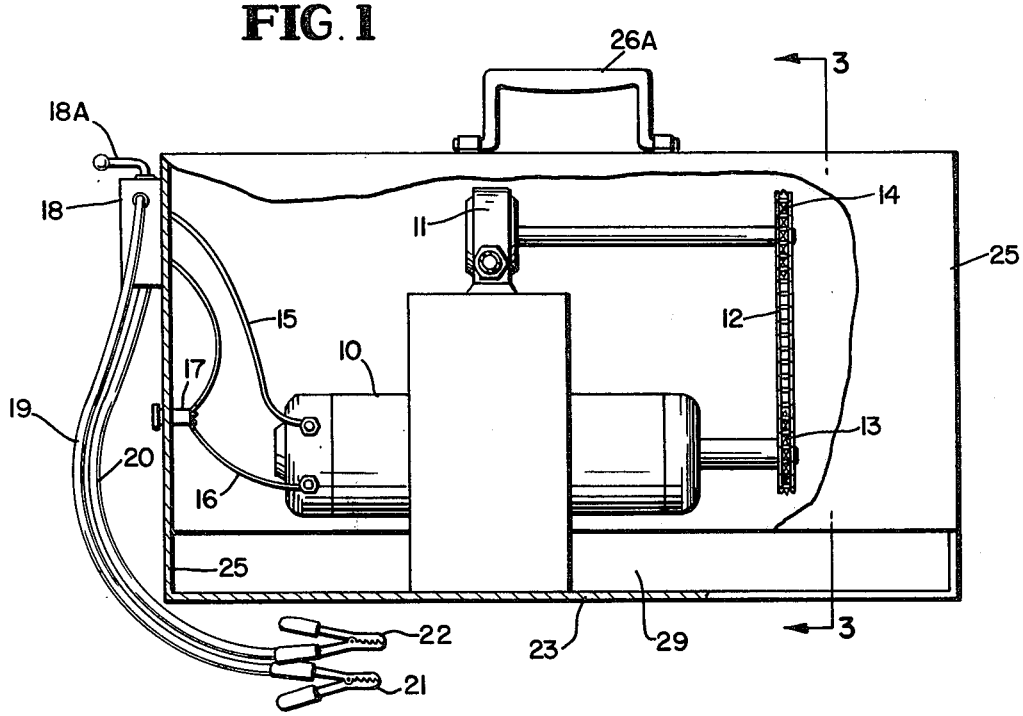
FIG. 1 is a side elevational view of the apparatus of the present invention with parts broken away and parts shown in section.

Referring now to the drawings and for the moment to FIG. 1, 10 is a 12 volt DC motor, one-third horsepower, 28 amps at 1,750 rpm which drives a positive displacement gear pump 11, through a chain drive 12. The motor sprocket 13 has 11 teeth while the pump drive sprocket 14 has 18 teeth. The motor 10 has positive and negative leads 15, 16 one of which is fused at 17. The leads are connected to a rotary type reversible switch 18 which has two battery leads 19, 20 extending off same with battery attaching clamps 21, 22 at their ends.

The motor 10 and pump 11 are mounted on a base 23 having sidewalls 24 and endwalls 25 and a top 26 having a carrying handle 26A. The pump 11 is a ¾ inch pump has an inlet hose 27 and a discharge hose 28 which pass through the side walls 24. The side walls 24 also have air vent openings 29 which run the length of the walls 24 to permit cooling air to circulate about the motor 10 and pump 11.

Figure 3:
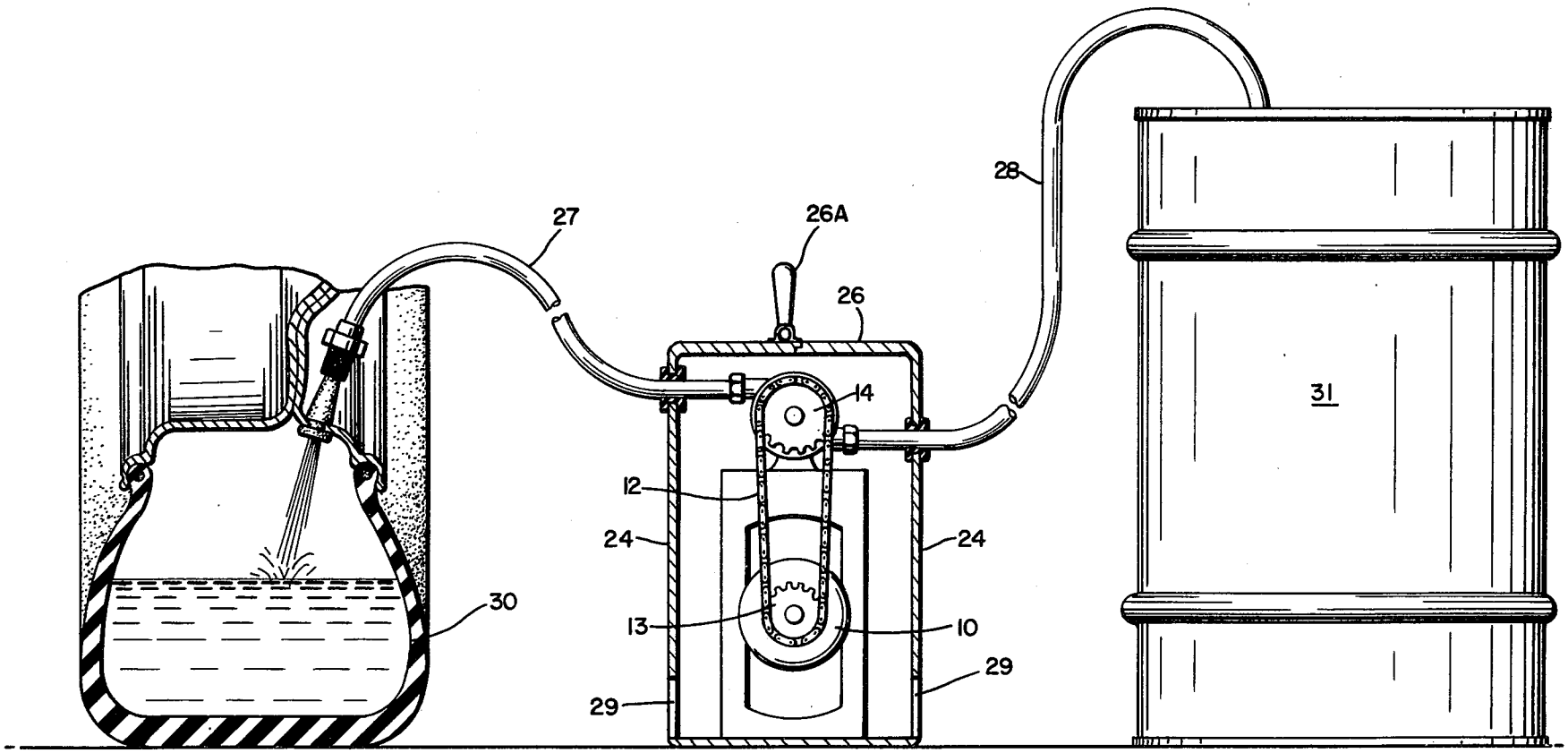
FIG. 3 is a side elevational view of the apparatus of FIG. 1 shown pumping calcium water from a holding drum back into a tractor tire.

The portable unit as best seen in FIG. 3 is shown pumping calcium water back into a giant tractor tire 30 from a holding drum 31. It will be appreciated that with the reversing switch 18 the handle 18A can be rotated to off, forward and reverse the water can be pumped from the tire 30 to the drum 31 or vice versa. Inlet and discharge to pump being a relative term dependent on the desired direction of flow.

Figure 2:
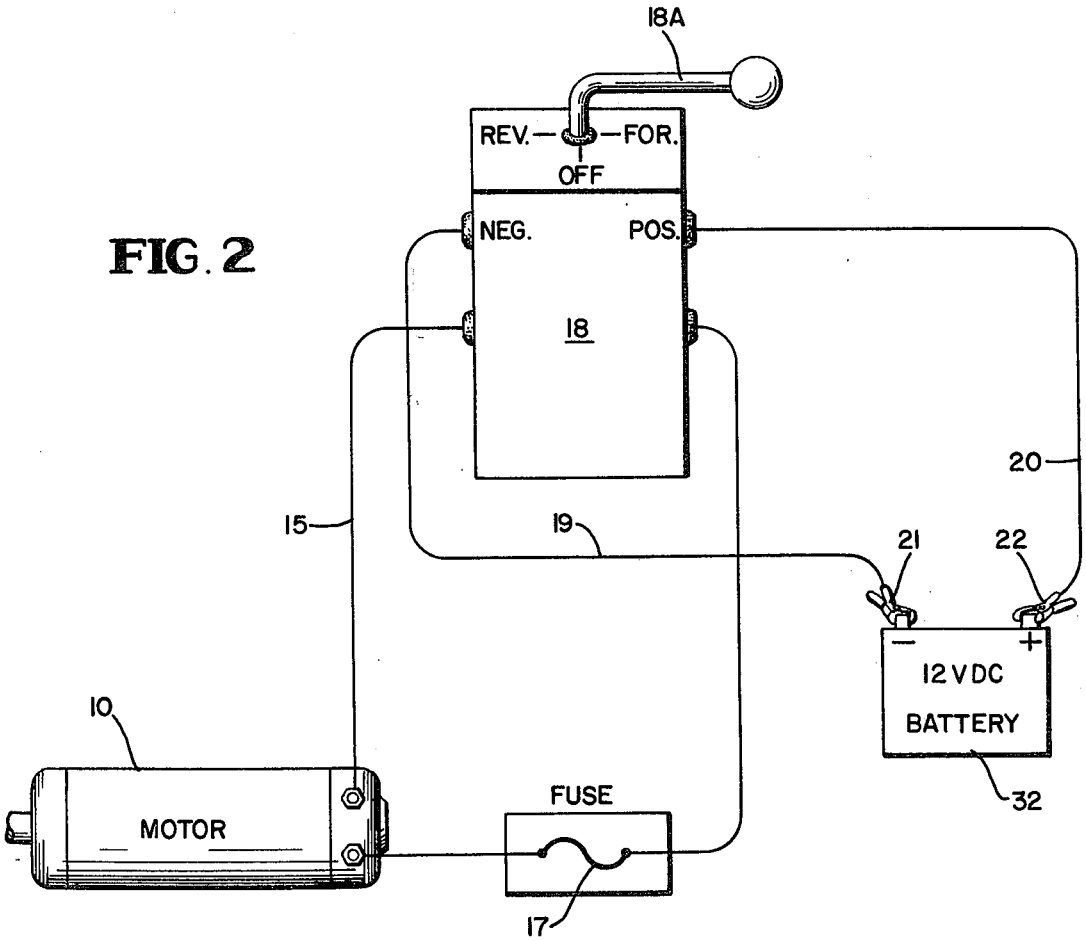
FIG. 2 is an electrical schematic of the apparatus of FIG. 1.

As shown in FIG. 2 the battery leads 19, 20 are connected to a 12V DC battery 32 of the 100 ampere hour type which is standard equipment on either a pick up truck or automobile.

While the apparatus of the present invention is shown in FIG. 3 pumping water to and from a large tire it will be appreciated that because of the extreme portability of the apparatus it will pump fluids from one place to another restricted only by the availability of a 12 volt DC battery and cables 19 and 20 being of sufficient length to reach the battery terminals. Suitable fittings can be placed on the free ends of hoses 27, 28 depending upon job requirements.

What I claim is:

1. An apparatus for transferring liquids from a reservoir container to a vehicle tire and vise versa comprising:

a. a base, b. motor support means upstanding from said base and secured thereto, c. a 12 V DC motor mounted in said motor support means, d. a positive displacement gear pump secured to the top of said motor support means, e. a sprocket and chain drive between said motor and gear pump, f. motor power leads adapted to be connected to the terminals of a 12 V DC battery, g. cover means over and secured to said base and motor support means having side, end walls and a top having a handle within which said motor and pump are housed, h. a reversing switch in circuit between said battery connection and said motor mounted exteriorly on said cover means, i. and a supply and discharge hose connected respectively to the intake and discharge of said pump and passing through the side walls of said cover means, said supply hose being receivable in said reservoir container and said discharge hose being connectable to said vehicle tire.

* * * * *